US010029846B2

(12) United States Patent
Frankenberg

(10) Patent No.: US 10,029,846 B2
(45) Date of Patent: Jul. 24, 2018

(54) WIRE DRUM

(71) Applicant: ORBIS Corporation, Oconomowoc, WI (US)

(72) Inventor: Jason R. Frankenberg, Lake Mills, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 15/427,227

(22) Filed: Feb. 8, 2017

(65) Prior Publication Data

US 2017/0225877 A1 Aug. 10, 2017

Related U.S. Application Data

(60) Provisional application No. 62/293,613, filed on Feb. 10, 2016, provisional application No. 62/372,607, filed on Aug. 9, 2016.

(51) Int. Cl.
*B65D 85/04* (2006.01)
*B65D 1/16* (2006.01)
(Continued)

(52) U.S. Cl.
CPC ..... *B65D 85/04* (2013.01); *B65D 1/16* (2013.01); *B65D 1/20* (2013.01); *B65D 1/40* (2013.01);
(Continued)

(58) Field of Classification Search
CPC ..... B65D 85/04; B65D 85/02; B65D 1/16; B65D 1/14; B65D 1/20; B65D 1/44; B65D 1/42; B65D 1/40; B65D 11/08; B65D 11/06; B65D 21/0216; B65D 21/0209; B65D 21/0233; B65D 21/04; B65D 25/10; B65D 25/04; B65D 25/02; B65D 25/30; B65D 25/38; B65D 25/56; B65D 25/54; B65D 7/045; B65D 7/04; B65D 7/02
USPC ..... 220/601, 674, 675, 669, 672, 670, 4.05, 220/4.04, 553, 676, 770, 501, 571, 661; 206/505, 504; 242/324.1
See application file for complete search history.

(56) References Cited

U.S. PATENT DOCUMENTS 559,358 A * 5/1896 Burt ..... A01G 23/10 220/571
3,096,951 A * 7/1963 Jenson ..... B65D 85/04 242/137.1
(Continued)

FOREIGN PATENT DOCUMENTS

DE 1939103 A * 7/1970 ..... B65D 1/16

OTHER PUBLICATIONS

Uline, Inc.; Product web page for "Fiber Drums"; retrieved from <http://www.uline.com/BL_8151?Fiber-Drums> on May 3, 2017 (1 page).

*Primary Examiner* — Robert J Hicks
(74) *Attorney, Agent, or Firm* — Greensfelder, Hemker & Gale, P.C.

(57) ABSTRACT

A molded plastic drum configured to hold wire. The drum includes a plastic interior cone. The cone can include ribs or other similar structure to simulate an outer cylindrical shape (or any other desired shape) to wrap the wire around. The cone is integrally formed with the rest of the container. The drum includes windows to determine the amount of wire in the drum. The drum can also include drain holes.

19 Claims, 4 Drawing Sheets

(51) Int. Cl.

| | |
|---|---|
| ***B65D 1/20*** | (2006.01) |
| ***B65D 1/40*** | (2006.01) |
| ***B65D 21/02*** | (2006.01) |
| ***B65D 25/10*** | (2006.01) |
| ***B65D 25/30*** | (2006.01) |
| ***B65D 25/38*** | (2006.01) |
| ***B65D 25/56*** | (2006.01) |

(52) U.S. Cl.
CPC ..... *B65D 21/0216* (2013.01); *B65D 25/10* (2013.01); *B65D 25/30* (2013.01); *B65D 25/38* (2013.01); *B65D 25/56* (2013.01)

(56) References Cited

U.S. PATENT DOCUMENTS 3,516,571 A * 6/1970 Roper ..... B65D 1/10 206/508
3,809,333 A * 5/1974 Lefever ..... B21C 47/20 206/409
4,429,805 A * 2/1984 Letica ..... B65D 1/22 220/675
D277,041 S 1/1985 Nichols
5,103,977 A * 4/1992 Douglas ..... B65H 75/364 206/388
5,165,559 A 11/1992 Kusz
5,183,179 A * 2/1993 Morris, Sr. ..... B65D 1/40 220/561
5,203,181 A 4/1993 Brossia
D336,714 S 6/1993 Brossia
5,467,890 A * 11/1995 Hussey ..... B01D 17/0208 210/540
5,549,215 A * 8/1996 Cruce ..... B29C 45/2628 206/516
D374,959 S 10/1996 Mull
D574,574 S 8/2008 Bax
8,646,660 B2 2/2014 Bates
8,777,056 B2 7/2014 Bates
D732,262 S 7/2015 Pellham
D735,436 S 7/2015 Lehman
D752,839 S 3/2016 Lehman
9,428,720 B2 8/2016 Lehman
2009/0266738 A1 * 10/2009 Dunford ..... B65D 21/0233 206/515
2013/0248535 A1 * 9/2013 Wolfe ..... B65D 25/04 220/500

* cited by examiner

WIRE DRUM

CROSS-REFERENCE TO RELATED APPLICATIONS

This application claims priority to U.S. Provisional Application Nos. 62/293,613, filed Feb. 10, 2016, and 62/372,607, filed Aug. 9, 2016, the contents of which are incorporated herein in their entirety.

FEDERALLY SPONSORED RESEARCH OR DEVELOPMENT

N/A

FIELD OF THE INVENTION

The present invention generally relates to a molded plastic, one-piece drum having an integrally formed internal projection for holding and transporting wire and related products.

BACKGROUND OF THE INVENTION

In the past, wire was transported in fiber containers having a cylindrical insert in the container. The wire was wrapped around the insert (i.e., confined between the insert and the container side wall). Such containers were not suited for stacking together when empty.

Additionally, the insert was prone to separation from the rest of the container. This led to the wire becoming unwound and/or tangled.

The present invention provides an improved wire drum.

SUMMARY OF THE INVENTION

The present invention provides a drum for transporting bulk wire. The drum is preferably formed from a molded plastic. The drum has a bucket shape with an integrally formed interior projection (such as a cone or other similar shape) extending upward from the base of the drum. The wire can be wrapped around the interior projection and will be confined between the projection and the side wall of the drum.

In accordance with one embodiment of the present invention, a wire drum comprises a molded plastic container having an outer cylindrical side wall extending upward from a base portion, and an interior projection extending upward from the base portion in an interior portion of the container. The interior projection is integrally formed with the base portion.

The interior projection can be a cone or other similar shape. The cone can include a plurality of radially outward extending ribs or other similar structure. The ribs can be used to provide a generally cylindrical outer profile for the wire to be wrapped around or other desired profile.

The outer cylindrical side wall of the container can include a plurality of openings for viewing into the interior portion of the container. The plurality of openings in the cylindrical side wall can be arranged or positioned linearly—extending from proximate the base portion toward an upper edge of the cylindrical side wall. In this manner, one can determine approximately how much wire is left in the drum via the openings. This can be useful if there is a top on the drum or a number of drums are stacked upon each other.

The wire drum can further comprise one or more handle openings formed in the cylindrical side wall, and/or can include handles connected to the drum. The cylindrical side wall can also comprise a rib extending outward from the cylindrical side wall. The rib can be used to facilitate stacking of the containers when empty.

The wire drum can also include one or more drainage openings in the interior projection. The drum can also include one or more drainage openings in the base portion.

The interior projection can further comprise a plurality of support ribs in an interior portion of the projection.

In accordance with another aspect of the invention, a wire drum is provided in the form of an outer container having a generally cylindrical side wall and an opening at a top end. The container includes a base connected to a bottom portion of the side wall and a hollow interior projection integrally connected to and extending upward from a central portion of the base.

The base of the wire drum can comprise a circular portion extending between the cylindrical side wall and the interior projection. The circular portion can include a plurality of downwardly extending ribs.

The interior projection can include a plurality of outwardly extending ribs. The outwardly extending ribs on the interior projection can each have an outer edge that collectively simulate a cylindrical surface.

The cylindrical side wall can include an opening for inspection of contents of the drum. Similarly, the cylindrical side wall can include a plurality of openings for inspection of contents in the drum. The plurality of openings can be arranged linearly up the side wall.

The wire drum is preferably formed from plastic as one piece. In this regard, the interior projection is integrally part of the base.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
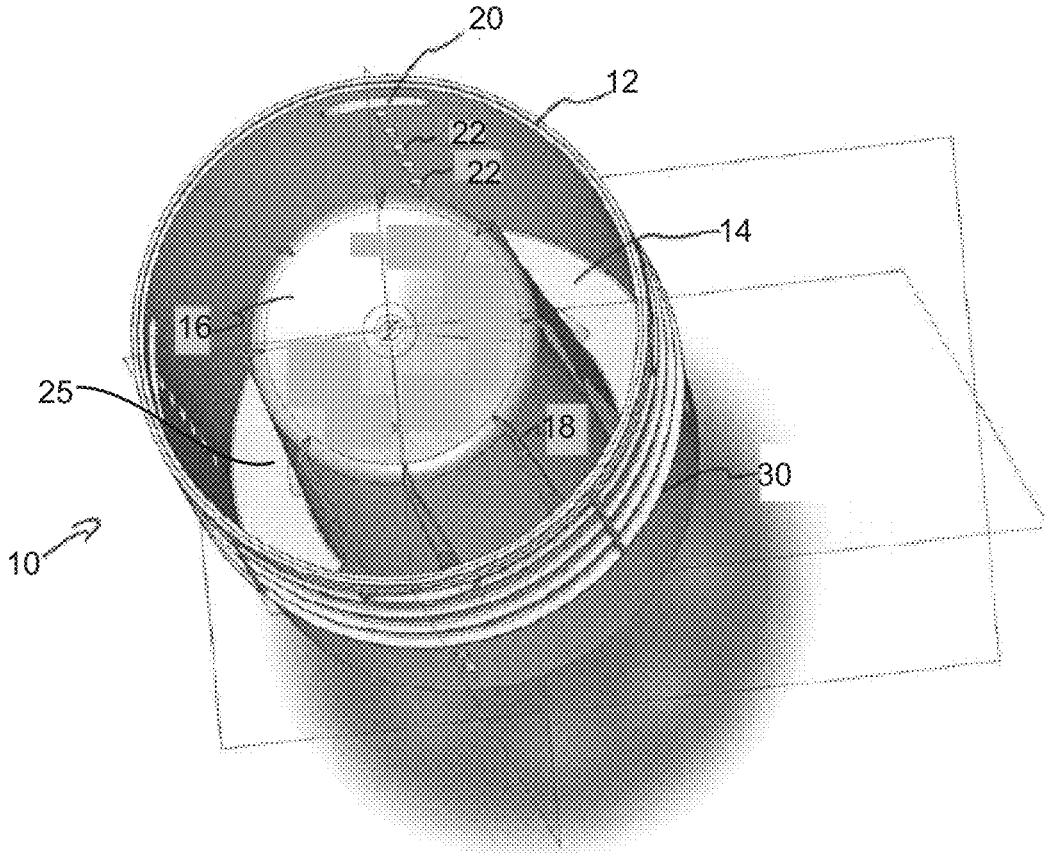
FIG. 1 is an elevated perspective view of a wire drum in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

FIGS. 1-4 shows a wire drum or container 10 in accordance with the present invention. The drum 10 has a cylindrical outer side wall 12 extending upward from a base portion 14.

The interior of the drum 10 includes an interior projection 16 extending upward from the base portion 14. As shown, the interior projection 16 has a generally cone shape with a flat top portion. A plurality of ribs 18 extend radially outward from the interior projection 16. The ribs 18 simulate a generally cylindrical outline or surface for wrapping the wire around.

The base 14 includes a flat portion 25 extending between the cylindrical side wall 12 and the interior projection 16. The flat portion 25 forms a ring or open circular portion about the bottom of the drum 10 surrounding the interior projection 16.

Figure 4:
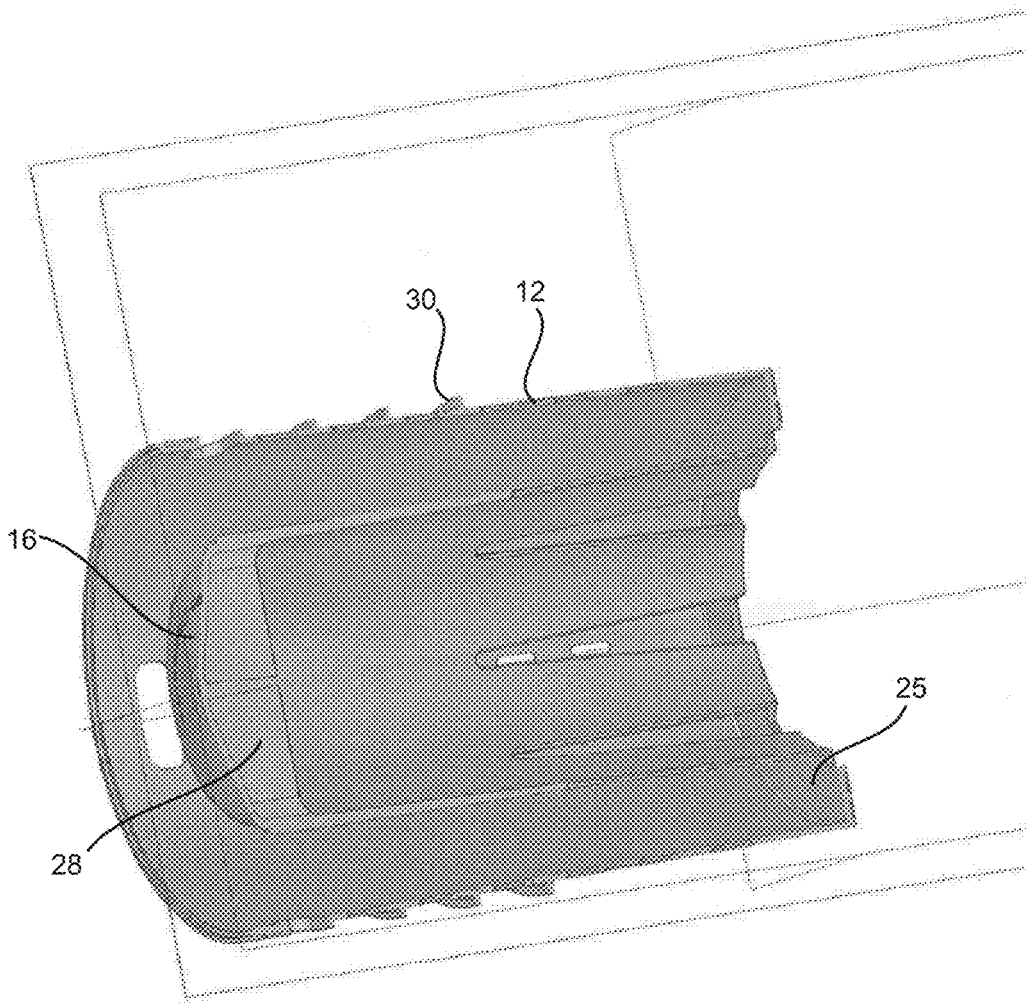

As illustrated in FIG. 4, the interior projection 16 is formed to have a hollow central portion. This allows the interior projection 16 in one drum 10 to stack with other similar drums 10.

The cylindrical wall 12 includes one or more handle openings 20 positioned proximate an upper edge of the wall. Additionally, the cylindrical wall 12 includes one or more openings or windows 22 that enable visual inspection of the interior of the drum 10. If a plurality of openings are employed, the openings 22 can be arranged linearly up the side wall 12 (however, other patterns can be employed). This allows one to easily determine approximately how much wire is in the drum 10.

Figure 2:
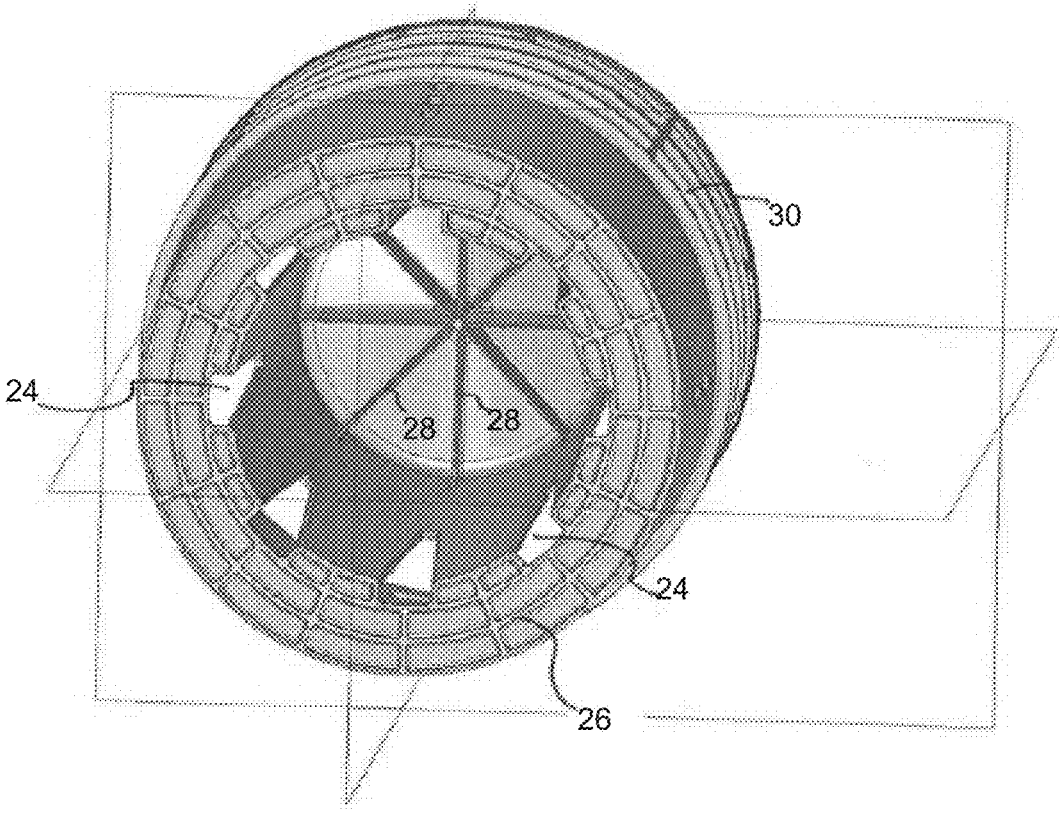
FIG. 2 is a perspective view of a bottom of the wire drum of FIG. 1.

As shown in FIG. 2, the interior projection 16 includes one or more drainage openings 24. The drainage openings 24 may also extend into a portion of the flat portion 25 of the base portion 14, or be only in the flat portion 25 of the base portion 14 (or the drum can include separate drainage openings in both the interior projection 16 and the flat portion 25 of the base portion 14).

The bottom surface of the base portion 14 includes a plurality of support ribs 26. Similarly, the interior projection 16 can include interior ribs 28 for extra strength and support. Additionally, ribs or other similar structure can be provided to facilitate placement of the wire in the drum (e.g., structure to secure one end of the wire to).

Figure 3:
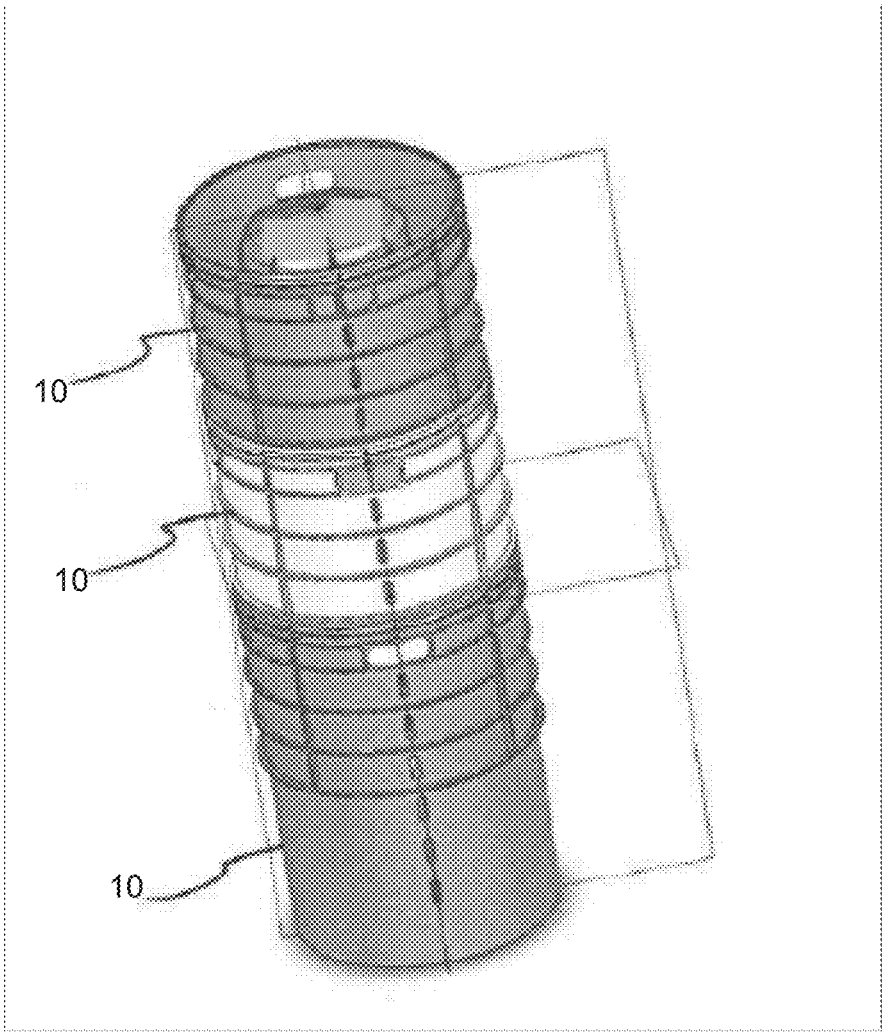
FIG. 3 is a perspective view of a plurality of wire drums stacked together; and, FIG. 4 is a cross section view of the wire drum of FIG. 1.

The outer cylindrical wall 12 also includes radially outwardly extending ribs 30. As illustrated in FIG. 3, the outwardly extending ribs 30 can be used to stack a plurality of empty drums 10 together. This enables efficient transport of empty drums 10.

The wire drum 10 is molded as a single piece of plastic (e.g., a one piece durable plastic construction). That is, the interior projection 16 is integrally formed with and connected to the base portion 14 of the drum 10.

The wire drum 10 can be formed with molded, recessed panels for receiving graphics. Moreover, the walls of the drum can be molded to include indicia or other graphics.

Many modifications and variations of the present invention are possible in light of the above teachings. It is, therefore, to be understood within the scope of the appended claims the invention may be protected otherwise than as specifically described.

I claim:

1. A wire drum comprising:

a molded plastic container having an outer cylindrical side wall extending upward from a base portion;

a hollow interior projection extending upward from an opening in the base portion in an interior portion of the container, wherein the interior projection is integrally formed with the base portion; and, a first drainage opening in one of the base portion and interior projection.

2. The wire drum of claim 1 wherein the interior projection is a cone.

3. The wire drum of claim 2 wherein the cone includes a plurality of radially outward extending ribs forming a cylindrical outer surface.

4. The wire drum of claim 1 wherein the outer cylindrical side wall includes a plurality of openings for viewing into the interior portion of the container.

5. The wire drum of claim 4 wherein the plurality of openings in the cylindrical side wall are positioned linearly extending from proximate the base portion toward an upper edge of the cylindrical side wall.

6. The wire drum of claim 1 further comprising a handle opening in the cylindrical side wall.

7. The wire drum of claim 1 further comprising a rib extending outward from the cylindrical side wall.

8. The wire drum of claim 1 further comprising a plurality of drainage openings in the interior projection.

9. The wire drum of claim 1 further comprising a plurality of drainage openings in the base portion.

10. The wire drum of claim 1 further comprising a plurality of support ribs in an interior portion of the interior projection.

11. A wire drum comprising:

an outer container having a generally cylindrical side wall and an opening at a top end;

a base connected to a bottom portion of the side wall;

a hollow interior projection integrally connected to and extending upward from a central opening in the base; and, a first drainage opening in one of the base and interior projection.

12. The wire drum of claim 11 wherein the base comprises a circular portion extending between the cylindrical side wall and the interior projection.

13. The wire drum of claim 12 wherein the circular portion includes a plurality of downwardly extending ribs.

14. The wire drum of claim 11 wherein the drum is formed from plastic as one piece.

15. The wire drum of claim 11 wherein the interior projection includes a plurality of outwardly extending ribs.

16. The wire drum of claim 15 wherein the outwardly extending ribs on the interior projection have an outer edge that collectively simulate a cylindrical surface.

17. The wire drum of claim 11 wherein the cylindrical side wall includes an opening for inspection of contents of the drum.

18. The wire drum of claim 11 wherein the cylindrical side wall includes a plurality of openings for inspection of contents in the drum.

19. The wire drum of claim 18 wherein the plurality of openings are arranged linearly up the side wall.

* * * * *